US009138083B1

(12) United States Patent
Hickey

(10) Patent No.: US 9,138,083 B1
(45) Date of Patent: Sep. 22, 2015

(54) WALL HANGER ASSEMBLY

(71) Applicant: Joseph F. Hickey, Morristown, NJ (US)

(72) Inventor: Joseph F. Hickey, Morristown, NJ (US)

(73) Assignee: 4 EVER LEVEL COMPANY, Piscataway, NJ (US)

( * ) Notice: Subject to any disclaimer, the term of this patent is extended or adjusted under 35 U.S.C. 154(b) by 0 days.

(21) Appl. No.: 14/120,864

(22) Filed: Jul. 7, 2014

(51) Int. Cl.
*A47F 7/14* (2006.01)
*A47G 1/16* (2006.01)

(52) U.S. Cl.
CPC ..... *A47G 1/1633* (2013.01)

(58) Field of Classification Search
CPC ..... A47G 1/16
USPC ..... 248/466, 475.1, 476, 477, 489, 493, 248/495, 496, 497; 40/757
See application file for complete search history.

(56) References Cited

U.S. PATENT DOCUMENTS 423,730 A * 3/1890 Charlton ..... 248/222.52
3,861,639 A * 1/1975 Morrill ..... 248/489
4,026,510 A * 5/1977 Holmes ..... 248/493
4,708,552 A * 11/1987 Bustos et al. ..... 411/80.1
4,863,135 A * 9/1989 Mellor et al. ..... 248/328
5,267,719 A * 12/1993 Keller ..... 248/493
5,803,425 A * 9/1998 McCoy, II ..... 248/493
D466,398 S * 12/2002 DeLine ..... D8/373
6,719,260 B1 * 4/2004 Hart ..... 248/479
7,198,244 B2 * 4/2007 Deline ..... 248/495
7,216,841 B2 * 5/2007 Dodig, Jr. ..... 248/475.1
7,891,124 B1 * 2/2011 Willis ..... 40/757
2005/0178942 A1 * 8/2005 Dodig, Jr. ..... 248/475.1
2006/0054771 A1 * 3/2006 Lie ..... 248/489
2006/0113454 A1 * 6/2006 Douglas ..... 248/477
2013/0232840 A1 * 9/2013 Miller ..... 40/757

* cited by examiner

*Primary Examiner* — Terrell McKinnon
*Assistant Examiner* — Michael McDuffie

(57) ABSTRACT

An improved hanger for mounting mirrors and pictures mounted in frames, the improved hanger having a top end and a bottom end, the top end having a groove disposed parallelledly to the wall on which the mirror or picture mounted in a frame is to be hung, the groove having a flared opening and parallel side walls terminating in a flat bottom wall having arcuate edges where the bottom wall intersects the side walls of the improved hanger, the improved hanger having at least one diagonal aperture there through for the receipt of a fastening means.

7 Claims, 2 Drawing Sheets

WALL HANGER ASSEMBLY

BACKGROUND OF THE INVENTION

1. Field of the Invention

This invention relates to hangers that are attached to walls for supporting objects such as small mirrors and small pictures mounted in frames.

2. Description of the Prior Art

Applicant is the holder of U.S. Pat. No. 5,482,244 for a hanger attached to a wall for supporting objects such as mirrors and pictures mounted in frames. The '244 patent discusses the prior art known to the Applicant at the time of the filing of that application, and it is incorporated herein.

The improved hanger incorporates improved structure developed by the Applicant through testing and use.

Applicant's improved hanger has application to small items such as pictures mounted in frames which may have taut wires stretched across their frames for hanging, and also to pictures mounted in frames which utilize a saw-tooth hanging clip for mounting.

OBJECTS OF THE INVENTION

An object of the present invention is to provide for a novel improved hanger for pictures mounted in frames which will safely support pictures mounted in frames.

It is another object of the present invention to provide for a novel improved hanger for pictures mounted in frames in which the hanger can support pictures mounted in frames which are hung by a taut wire or by a saw-toothed hanging clip.

It is a still further object of the present invention to provide for a novel improved hanger for pictures mounted in frames in which when mounted, neither the improved hanger, the taut metal wire, or the saw-toothed hanging clip are visible.

It is a further object of the present invention to provide for a novel improved hanger for pictures mounted in frames which provides stability to the mirror or picture mounted in frame.

SUMMARY OF THE INVENTION

An improved hanger for mounting pictures mounted in frames, and in particular, the improved hanger having a top end and a bottom end, the top end having a groove disposed parallelledly to the wall on which the mirror or picture mounted in a frame is to be hung, the groove having a flared opening and tapered side walls terminating in a flat bottom wall of the groove having arcuate edges where the bottom wall intersects the side walls of the improved hanger, the improved hanger having at least one downwardly angled countersunk aperture there through for the receipt of a fastening means.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
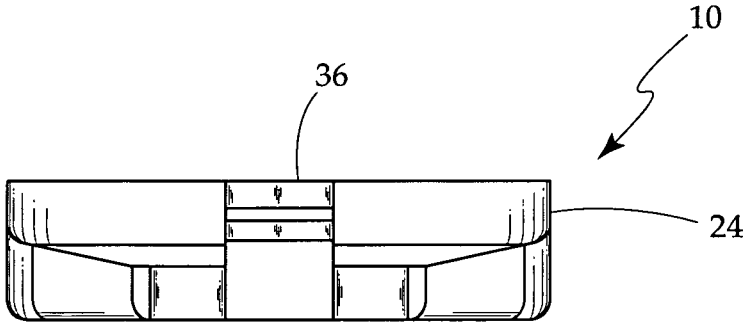
FIG. 1 is a front view of the improved hanger of the present invention.
Figure 2:
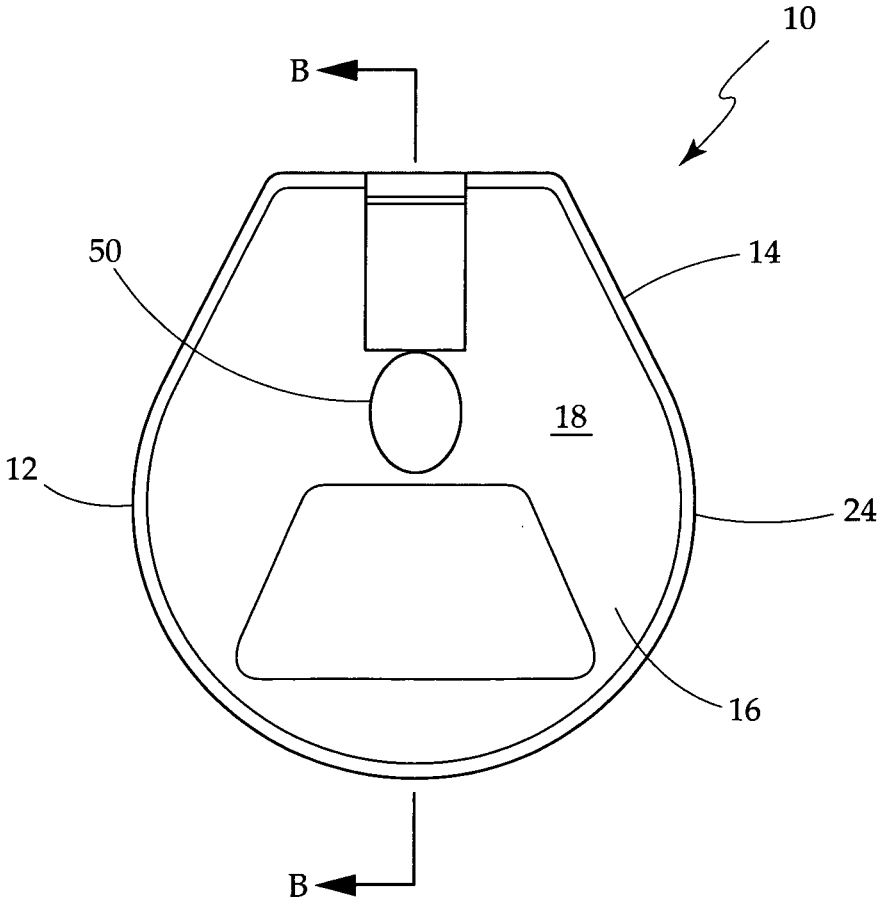
FIG. 2 is a top view of the improved hanger of the present invention.
Figure 3:
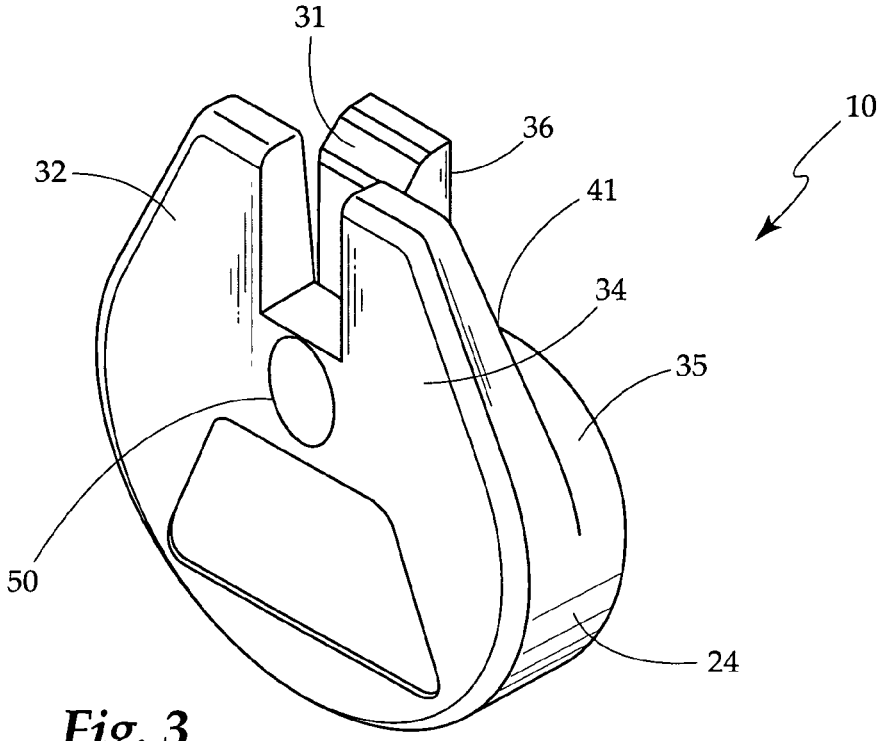
FIG. 3 is a perspective view of the improved hanger of the present invention.
Figure 4:
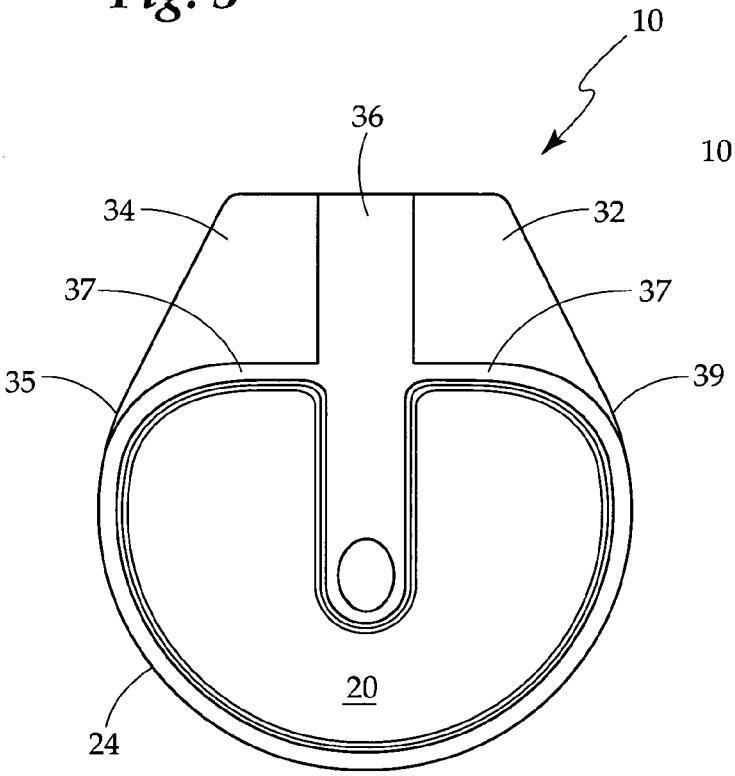
FIG. 4 is a rear view of the improved hanger of the present invention.
Figure 5:
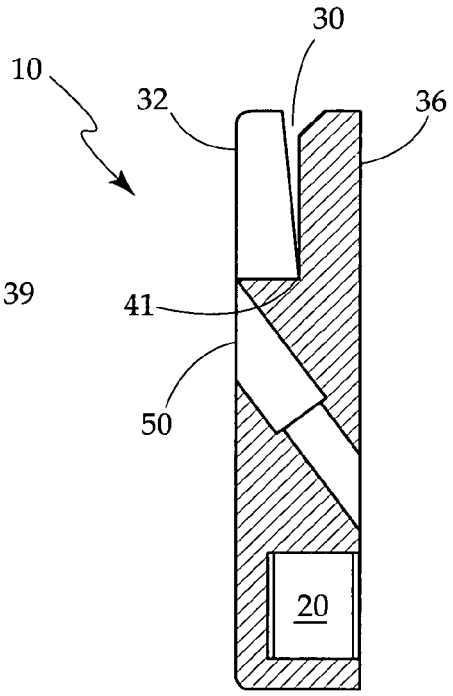
FIG. 5 is a side cutaway view of The improved hanger of the present invention.

FIG. 3 is a perspective view of the improved hanger of the present invention, FIG. 2 is a top view, FIG. 1 is a front view, FIG. 4 is a rear view, and FIG. 5 is a cutaway side view. The improved hanger 10 has a body portion 12 defined by an upper groove portion 14 and a lower support portion 16. Body portion 12 is further defined by a front face 18, and a rear indented face 20, which will juxtapose the wall of a room onto which the improved hanger 10 is positioned in order to support a picture mounted in a frame. The improved hanger 10 also is defined by a peripheral side wall 24.

One improvement of improved hanger 10 is with respect to the cross-section of the groove portion 14 itself as more fully illustrated in FIGS. 3 and 5. The groove portion is V-cut 30 in cross-section across the upper peripheral wall of the improved hanger 10, having parallel bifurcated front walls 32 and 34 and a spaced apart rear wall 36, the spatial separation defining V-cut 30. Still further, the bottom wall 41 is centrally planar at 37 and at its terminal intersections 35 and with the peripheral side wall 24, the bottom wall 41 is arcuate or rounded as it intersects with the peripheral side wall thereby eliminating any angled intersection which could abrade a wire.

The width of the groove or slot 30 is sufficient to receive the saw tooth horizontal portion of a hanging clip attached to the top frame member of a picture mounted in a frame and at the same time is adapted to accept a picture wire attached to a picture frame. The beveled front portion 31 of rear wall 36 allows for the facile positioning and engagement of either type of hanging device into groove or slot 30. The curvature of the terminus of the intersection of the planar bottom wall 41 with the peripheral side walls 24 eliminates any sharp edges with respect to a wire attachment and eliminates any unwanted pressure points either on the wire attachment itself or the pressure exerted by the wire onto the hanger as a result of the weight of the attached mirror or picture mounted in a frame.

Parallel bifurcated front walls 32 and 34 and spaced apart rear walls 36 which define the spacial separation defining V-cut 30, are in the preferred embodiment, somewhat flexible so that the width of the cut 30 can vary and accept varying thicknesses of wire. The flexibility allows for the wire to be positioned more deeping within V-cut 30 and actually grasp or frictionally engaged by the bifurcated front walls 32 and 34 and rear wall 36 to prevent slippage.

Another improvement to improved hanger 10 of the present invention is the manner of securing it to the wall and stabilization by the support portion 16. A centrally disposed aperture 50 which is countersunk and angularly downwardly disposed and dimensioned to wall fasteners which substantially increase the weight capacity of the improved hanger and minimize safety concerns. The countersunk aperture allows the head of the fastener to be recessed allowing the hanging object to be flush with the wall.

The wall fastener utilized with centrally disposed aperture provides the increased weight bearing capacity. The downwardly angularly countersunk aperture 50 also provide additional weight bearing capacity. When the improved hanger 10 is attached to a wall, it is sufficiently elevated that it easily fits into a groove between saw teeth of a picture hanging clip that is attached to the top frame member of a picture, or the like, thereby being hidden from view. It is also well adapted to accept a picture wire attached to a picture frame, and because of the flat planar bottom of the groove, and the rounded edges, minimize any tendency for the wire to slip sideways and cause the picture frame to tilt. Its use with a wire frame also permits it to be hidden from view.

Improved hanger 10 is manufactured from a polymer, such as propylene, epoxy, nylon, or polycarbonate. It is inexpensive to manufacture, light in weight, yet strong and rigid. Improved hanger 10 as illustrated, is generally ovoid in shape. It will be recognized by those of ordinary skill in the art that the body portion shape may vary.

Improved hanger 10 can also be produced in a range of sizes for supporting picture frames of a variety of sizes and weights. Generally, the greater the surface area of the support portion 16, the greater weight can be supported. Further, having the groove or slot 30 close to the wall is advantageous when supporting very small pictures, because the picture will be able to hug the wall.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. A hanger for hanging objects from a wall, the hanger comprising:

a lower support portion having a front face, a rear face, and peripheral side faces between the front face and the rear face, and an upper portion, wherein the upper portion includes two vertical, spaced-apart front walls each having a front face facing in the same direction as the front face of the lower support portion and a rear face facing in the same direction as the rear face of the lower support portion, wherein the upper portion further includes a vertical rear wall centered on the space between the spaced-apart front walls, wherein the rear wall has a front face facing in the same direction as the front face of the lower support portion, a rear face facing in the same direction as the rear face of the lower support portion, and first and second peripheral side faces extending between the rear wall front face and the rear wall rear face, wherein the width of the rear wall across its front and rear faces is substantially less than the distance between the peripheral side faces of the lower support portion, wherein the lower support portion has first and second upward-facing faces each extending from a respective one of the peripheral side faces of the rear wall to a respective one of the peripheral side faces of the lower support portion, the first and second upward-facing faces having respective rounded end termini that merge with the respective one of the peripheral side faces of the lower support portion, wherein the rear face of one of the front walls and the front face of the rear wall terminate in respective edges that meet to form a first V-shaped opening, and wherein the rear face of the other one of the front walls and the front face of the rear wall terminate in respective edges that meet to form a second V-shaped opening.

2. The hanger of claim 1 wherein said first and second V-shaped openings are dimensioned to accept a saw-toothed hanging clip and are further dimensioned to grasp a picture wire inserted into the two V-shaped openings.

3. The hanger of claim 1, wherein the hanger is made from at least one of polypropylene, epoxy, nylon, and polycarbonate.

4. The hanger of claim 1, wherein one or more of a) the front walls and b) the rear wall are sufficiently flexible that picture wires of varying thicknesses can be inserted into the V-shaped openings and be frictionally grasped by the front and rear walls.

5. The hanger of claim 1, wherein the width of the rear wall across its front and rear faces is substantially equal to the space between the spaced-apart front walls.

6. The hanger of claim 1, wherein the front face of the rear wall has a beveled top.

7. The hanger of claim 1, wherein said lower support portion includes an aperture for receipt of a fastener.

* * * * *